US012473816B2

(12) United States Patent
Johnson et al.

(10) Patent No.: US 12,473,816 B2
(45) Date of Patent: Nov. 18, 2025

(54) MITIGATION OF SEVERE DYNAMIC VIBRATIONS VIA STICK SLIP PROMOTION

(71) Applicant: Schlumberger Technology Corporation, Sugar Land, TX (US)

(72) Inventors: Ashley Bernard Johnson, Milton (GB); Nathaniel Wicks, Somerville, MA (US); Amandine Battentier, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/830,774

(22) Filed: Sep. 11, 2024

(65) Prior Publication Data

US 2025/0084752 A1 Mar. 13, 2025

Related U.S. Application Data

(60) Provisional application No. 63/581,782, filed on Sep. 11, 2023.

(51) Int. Cl.
*E21B 44/04* (2006.01)

(52) U.S. Cl.
CPC ..... *E21B 44/04* (2013.01)

(58) Field of Classification Search
CPC ..... E21B 44/04; E21B 44/00
See application file for complete search history.

(56) References Cited

U.S. PATENT DOCUMENTS

2013/0066471 A1* 3/2013 Wang ..... G05B 13/024 700/275
2015/0101865 A1 4/2015 Mauldin et al.
2019/0368332 A1* 12/2019 Sun ..... E21B 3/022
2020/0173270 A1 6/2020 Zhan

FOREIGN PATENT DOCUMENTS

EP 2462315 B1 11/2018

* cited by examiner

*Primary Examiner* — James G Sayre

(57) ABSTRACT

A method for drilling a subterranean wellbore includes rotating a bottom hole assembly in the wellbore to drill and measuring a magnitude of a potentially damaging vibrational component. The measured magnitude is compared to a corresponding threshold and the drill string rotation may be perturbed to increase stick slip when the measured magnitude exceeds the threshold.

20 Claims, 7 Drawing Sheets

MITIGATION OF SEVERE DYNAMIC VIBRATIONS VIA STICK SLIP PROMOTION

CROSS REFERENCE TO RELATED APPLICATIONS

This application claims priority to U.S. Provisional Patent Application No. 63/581,782, which was filed on Sep. 11, 2023, and is incorporated herein by reference in its entirety.

BACKGROUND

Severe dynamic conditions are often encountered while drilling subterranean wellbores (e.g., for oil and gas exploration and production). Such dynamic conditions may include axial vibrations including bit bounce, lateral vibrations including whirl, and torsional vibrations including stick slip. Lateral vibrations are generally the most destructive type of drill string vibration and sometimes cause large shocks as the bottom hole assembly (BHA) impacts the wellbore wall. In particular, backward whirl can cause the most violent vibrations, and may cause high frequency, large magnitude bending moments that lead to severe component and connection fatigue and even to catastrophic failure of the drill string. High-frequency torsional oscillations and harmonic stick slip oscillations can also be highly destructive, for example, leading to thread damage and twist off failure in the drill string or BHA.

Owing to their highly destructive potential, the whirling phenomena (and particularly backward whirl) and other damaging torsional oscillations have been the subject of considerable evaluation. Mitigation efforts commonly involve developing balanced drill string components and identifying drilling parameters that reduce damaging oscillation tendency. Despite these intensive efforts, these vibrational modes remain a challenging problem to the driller. There is room for improved methods of severe dynamic vibration mitigation, particularly backward whirl mitigation, high-frequency torsional oscillation mitigation, and harmonic stick slip oscillation mitigation.

SUMMARY

In one example embodiment, a method for drilling a subterranean wellbore comprises rotating a drill string in a wellbore; measuring at least one of a whirl, a high frequency torsional oscillation, and a harmonic stick slip oscillation while rotating; comparing the at least one of the whirl, the high frequency torsional oscillation, and the harmonic stick slip oscillation with a corresponding threshold; and perturbing the rotating to increase stick slip when the at least one of the whirl, the high frequency torsional oscillation, and the harmonic stick slip oscillation exceeds a corresponding threshold.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

In example embodiments a method for drilling a subterranean wellbore includes measuring a magnitude of a potentially damaging vibrational component while rotating a drill string in a wellbore and comparing the measured magnitude with a corresponding threshold. The rotation may be perturbed to increase stick slip when the measured magnitude exceeds the threshold to reduce the damaging vibrations.

In other example embodiments a method for drilling a subterranean wellbore includes measuring a stick slip amplitude while rotating a drill string in a wellbore and comparing the measured stick slip amplitude with a corresponding stick slip threshold. The rotation may be perturbed to increase stick slip when the measured magnitude is less than the threshold to mitigate against other potential damaging drill string vibrations.

Figure 1:
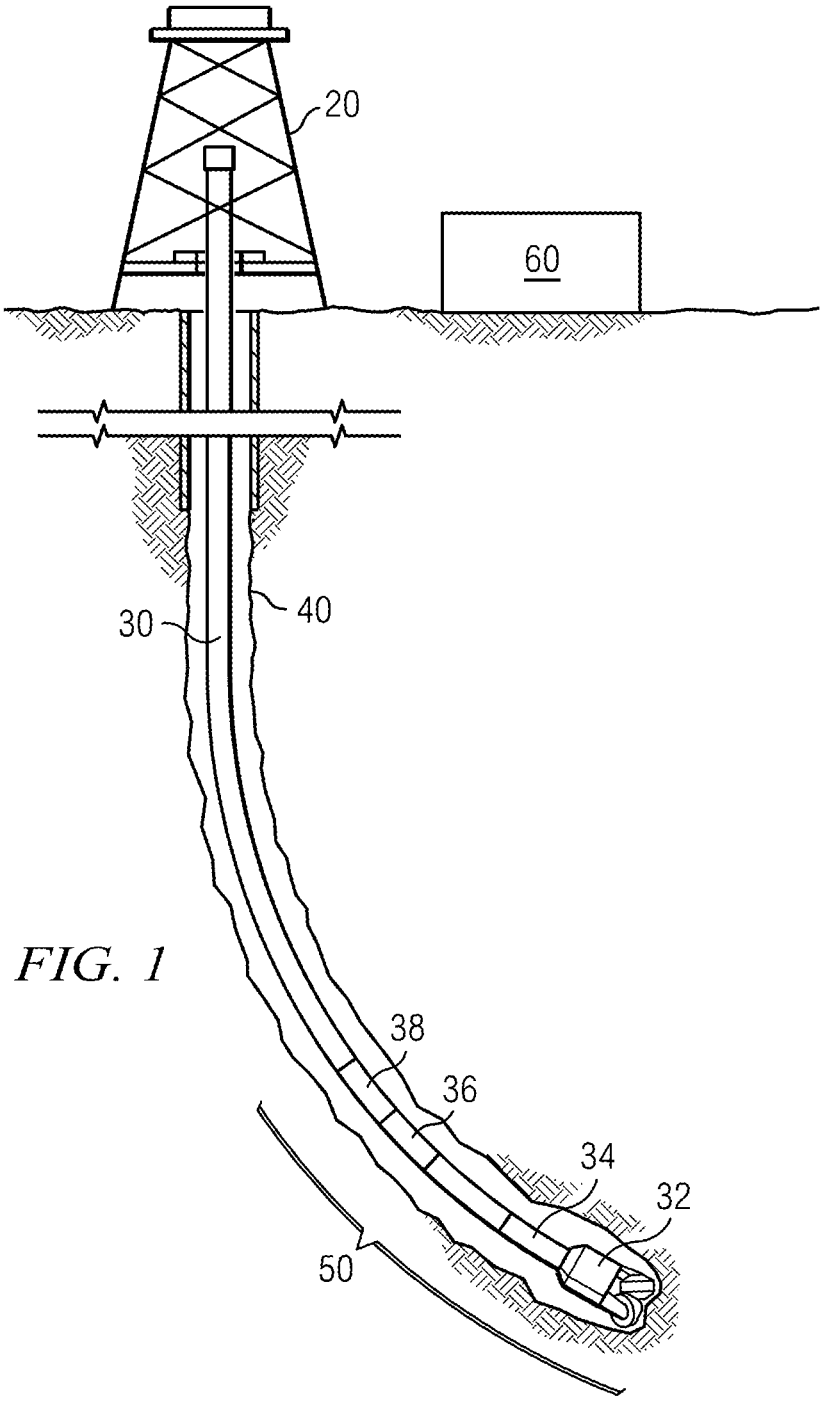
FIG. 1 depicts an example drilling rig suitable for making LWD measurements.

FIG. 1 depicts a schematic drilling rig 20 including a drill string 30 and bottom hole assembly 50 deployed in the string and disposed within a wellbore 40. The drilling rig 20 may be deployed in either onshore or offshore applications (an onshore application is depicted). Moreover, the wellbore may be inclined at substantially any angle and may include vertical, horizontal, and building sections (a wellbore including a vertical section and a building section is depicted). The disclosed embodiments are not limited to any particular wellbore configuration. In the depicted example, the wellbore 40 may be formed in subsurface formations by rotary drilling in a manner that is well-known to those of ordinary skill in the art (e.g., via known directional drilling techniques).

As is known to those of ordinary skill, the drill string 30 may be rotated, for example, at the surface to drill the well (e.g., via a rotary table) or via a hydraulically powered motor deployed in or above the BHA 50. A pump may deliver drilling fluid through the interior of the drill string 30 to the drill bit 32 where it exits the string via ports therein. The fluid may then circulate upwardly through the annular region between the outside of the drill string 30 and the wall of the wellbore 40. In this known manner, the drilling fluid lubricates the drill bit 32 and carries formation cuttings up to the surface.

In the illustrated example embodiment, the BHA 50 may include any number of downhole tools, for example, including a steering tool 34 (such as a rotary steerable tool), a logging while drilling (LWD) tool 36 and a measurement while drilling (MWD) tool 38. The steering tool 34, the LWD tool 36, and/or the MWD tool 38 may optionally include one or more sensors, such as magnetometers and/or accelerometers, that are configured to identify and or quantify BHA vibrations (particularly stick slip and whirl). The BHA may further include one or more stabilizers as well as other tools such as a reamer. The disclosed embodiments are not limited to any particular BHA configuration.

FIG. 1 further depicts an optional onsite operations or oilfield evaluation facility 60 (e.g., a control room or a field office). In the depicted embodiment, the facility 60 may include a system, such as a computer or computer system, for evaluating downhole vibrational measurements and recommending or automatically actuating changes to the drilling parameters to mitigate severe dynamic vibrations, such as whirl, HFTO, and harmonic stick slip oscillations. The computer system may include one or more processors (e.g., microprocessors) which may be connected to one or more data storage devices (e.g., hard drives or solid-state memory) and user interfaces as well as to cloud-based storage or additional cloud-based processors. It will be further understood that the disclosed embodiments may include processor executable instructions stored in the data storage device. The executable instructions may be configured, for example, to execute methods 100, 120, 140, 160, 180, and 200 described in more detail with respect to FIGS. 5-10. It will of course be understood that the disclosed embodiments are not limited to the use of any particular computer hardware and/or software.

Figure 2A:
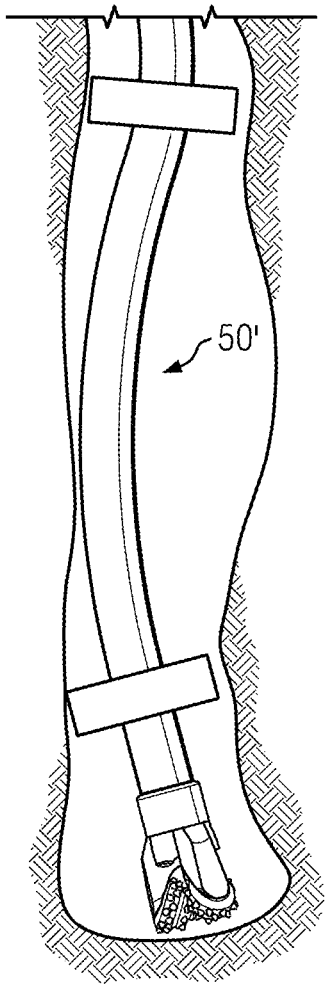
FIGS. 2A, 2B, and 2C (collectively FIG. 2) depict an example BHA configuration (2A) undergoing forward (2B) and backward (2C) whirl.
Figure 2B:
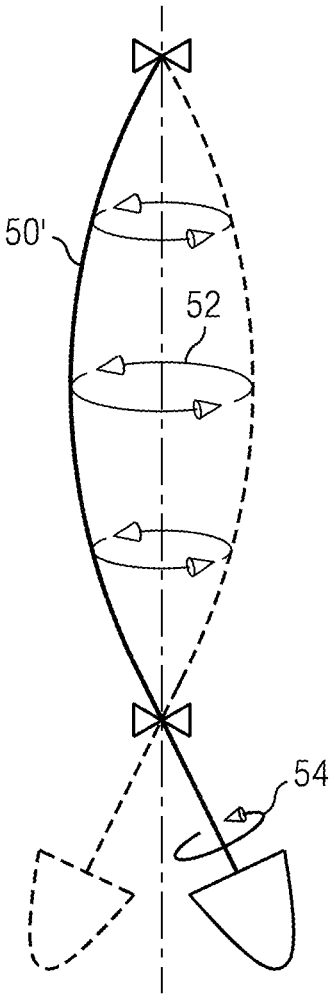
Figure 2C:
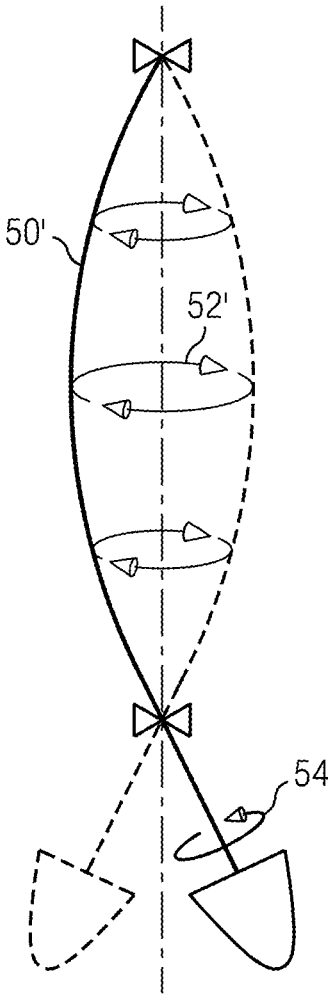

FIGS. 2A, 2B, and 2C (collectively FIG. 2) depict an example BHA configuration 50' (2A) undergoing forward (2B) and backward (2C) whirl. As depicted, there are generally considered to be two types of whirling motion: forward and backward whirl. In forward whirl the direction of the whirling motion 52 is the same as the direction of the rotation of the BHA 54 as shown in FIG. 2B. In backward whirl, the direction of the whirling motion 52' is in the opposite direction(backwards to) the direction of the rotation of the BHA 54 as shown in FIG. 2C. It will be appreciated by those of ordinary skill, that whirl can also be chaotic, oscillating back and forth between forward and backward whirl motion. As noted above, backward whirl is commonly considered to be more destructive and detrimental to the drilling operation since it can generate high frequency, large amplitude vibrations that damage downhole tools. Backward whirl is not only destructive to the BHA, but can also damage the integrity of the wellbore (as the BHA repeatedly strikes the wellbore wall).

One aspect of the disclosed embodiments was the realization that stick slip vibrations at the fundamental frequency and whirl vibrations, HFTO, and harmonic stick slip oscillations are often negatively correlated or even mutually exclusive. In other words, it was realized that stick slip vibrations do not generally occur simultaneously with the more damaging vibrational modes such as backward whirl. Moreover, it was further realized that severe dynamic vibrations (such as whirl) and stick slip at the fundamental frequency can (and often do) displace one another. It was therefore still further realized that one way to mitigate against highly damaging vibrations (such as backward whirl) is to promote the less damaging stick slip conditions (e.g., to intentionally introduce or promote stick slip oscillations while drilling).

It will be appreciated that the disclosed embodiments are not strictly limited to while drilling activities in which the drill bit is rotating on bottom. It will be further appreciated that highly damaging vibrations can (and sometimes do) occur during other drilling related activities, for example, rotating the drill string and circulating drilling fluid when the drill bit is off bottom or when rotating while tripping. Therefore, it will be understood that the term "drilling" as used herein is used in the broader context to refer to drilling related activities whether or not the drill bit is on or off bottom.

Figure 3:
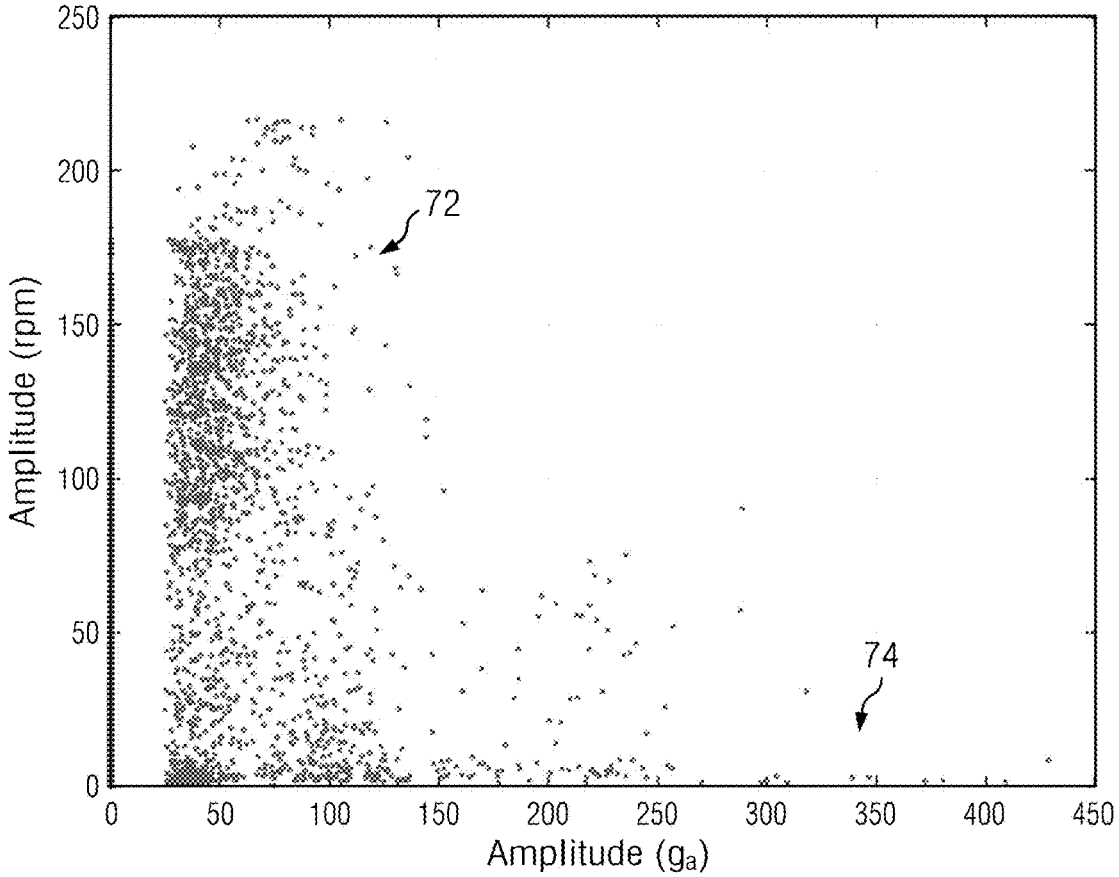
FIG. 3 depicts a plot of stick slip amplitude versus radial shock during an example drilling operation.

FIG. 3 depicts a scatter plot (or cross plot) of stick slip amplitude versus radial shock during an example drilling operation. In this example, the stick slip amplitude is one half of the peak to peak (maximum rotation rate minus minimum rotation rate) at a stick slip frequency between 0.15 and 0.5 Hz in units of RPM. The whirl was quantified as the maximum radial (lateral) acceleration in units of gravitation force equivalents. In this example, both the stick slip amplitude and the whirl amplitude were measured using dedicated vibration sensors (including accelerometers and magnetometers) deployed in a PowerDrive® rotary steerable drilling tool. As indicated in the example, whirl is generally low when stick slip is high as indicated at 72 and stick slip is generally very low when whirl is high as indicated at 74.

Figure 4A:
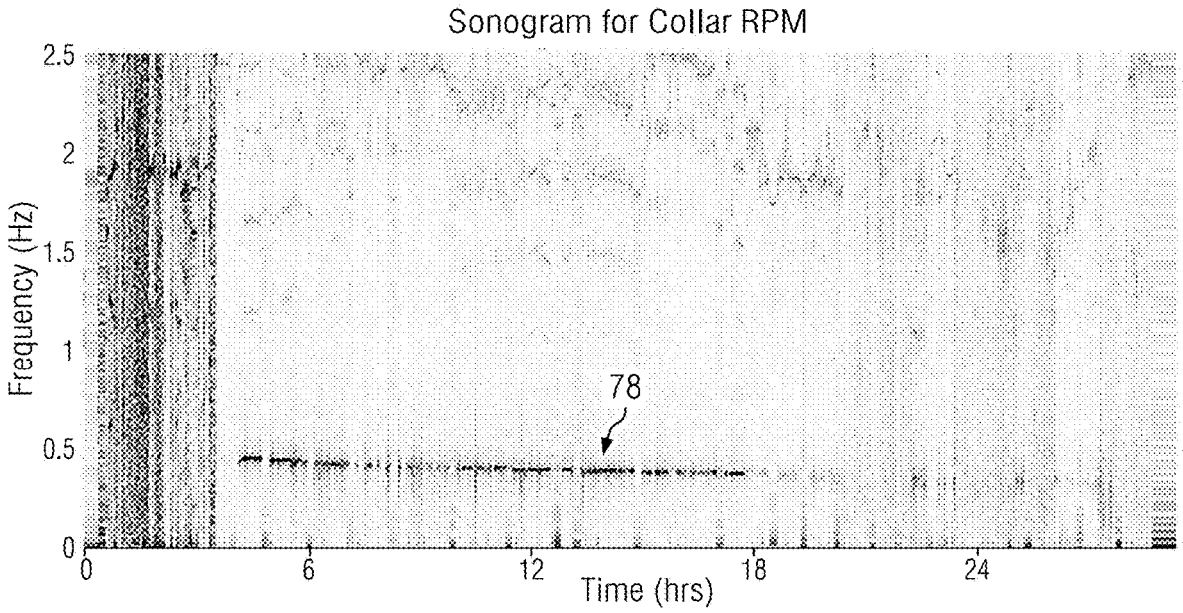
FIGS. 4A, 4B, and 4C (collectively FIG. 4) depict a sonogram for collar RPM (4A) and plots of stick slip amplitude (4B) and lateral shock (4C) during the same example drilling shown on FIG. 3.
Figure 4B:
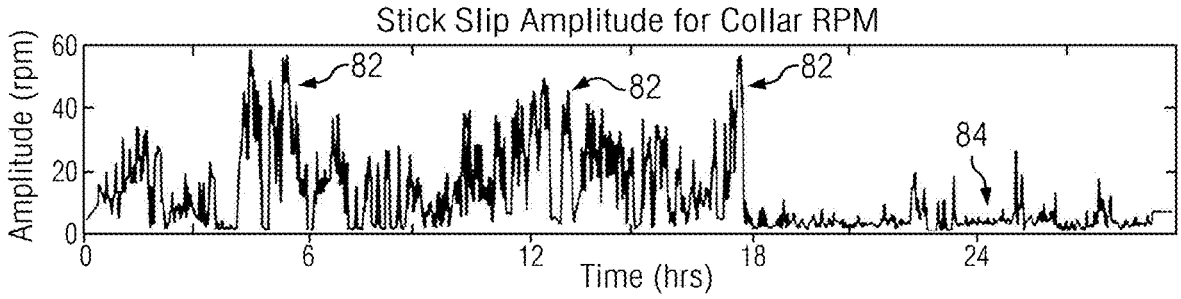
Figure 4C:
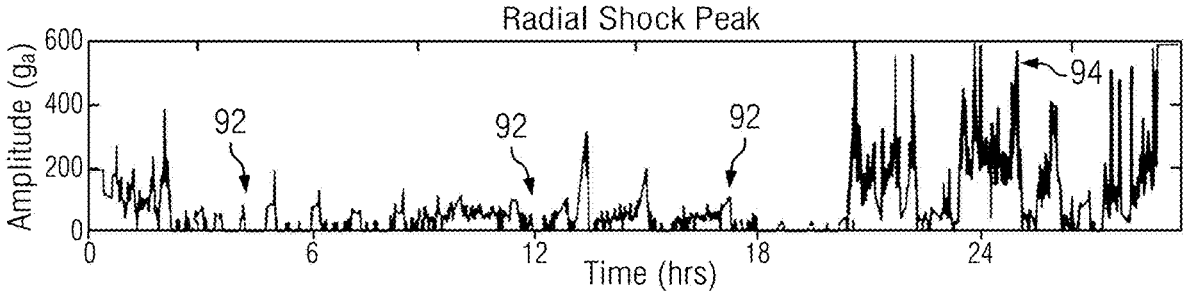

FIGS. 4A, 4B, and 4C (collectively FIG. 4) depict a sonogram for collar RPM (4A) and plots of stick slip amplitude (4B) and lateral shock (4C) during the same example drilling operation described above with respect to FIG. 3. In this example, the stick slip oscillations have a dominant frequency of about 0.5 Hz as indicated at 78 (4A). Moreover, the stick slip (4B) and lateral shock (4C) are negatively correlated. In other words, as noted above with respect to FIG. 3, whirl is generally very low when stick slip is high as indicated at 82, 92 and stick slip is generally very low when whirl is high as indicated at 84, 94.

Figure 5:
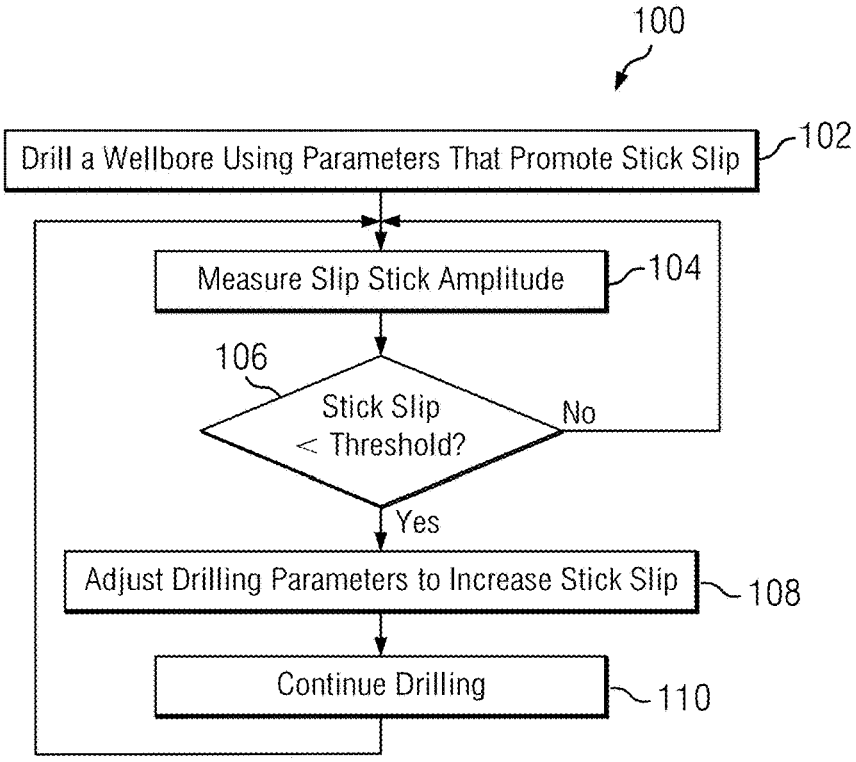
FIG. 5 depicts a flow chart of one example method for mitigating severe dynamic vibrations during a wellbore operation.

FIG. 5 depicts a flow chart of one example method 100 for mitigating severe dynamic vibrations during a wellbore operation. The method includes drilling the well (e.g., via rotating the drill string) at 102 using drilling parameters that promote moderate stick slip vibrations. Initial parameters that promote stick slip oscillations may be estimated, for example, via BHA modeling. The stick slip amplitude is measured at 104. The measurement may include, for example, a maximum stick slip amplitude in a predetermined time interval or in a predetermined frequency range (e.g., at the fundamental frequency). The stick slip amplitude may be measured using any suitable measurement techniques, for example, employing downhole magnetometers configured to measure a rotation rate of the drill string. The measurement may further include computing a Fast Fourier Transform (FFT) of the rotation rate to evaluate a dominant frequency or a stick slip amplitude at a frequency (or in a range of frequencies). The dominant frequency can also be determined by computing an FFT of the surface torque.

The measured stick slip amplitude is compared with a threshold at 106 (e.g., a predetermined threshold). When the stick slip amplitude is less than the threshold, the drilling parameters used to drill the well in 102 may be adjusted or perturbed at 108 so as to increase stick slip. It will be appreciated, that in an alternative embodiment the measured stick slip may be compared with predetermined upper and lower stick slip thresholds at 106. As described above, when the stick slip amplitude is less than the lower threshold, the drilling parameters may be adjusted at 108 so as to increase stick slip. When the stick slip amplitude is greater than the upper threshold, the drilling parameters may be adjusted so as to decrease the stick slip amplitude (and thereby mitigate against potential damage caused by too much stick slip). Drilling continues at 110 as indicated.

With continued reference to FIG. 5, it will be appreciated that it is generally desirable to drill with no drill string vibrations (to the extent possible). Therefore, while method 100 may advantageously prevent severe dynamic vibrations, such as whirl, HFTO, and harmonic stick slip oscillations, it also introduces moderate stick slip. In some operations, other methods that directly measure the severe dynamic vibrations may be desirable and may advantageously enable reduced overall vibration while drilling certain sections of the well. In such methods, stick slip is only introduced when the severe dynamic vibrations exceed the threshold.

Figure 6:
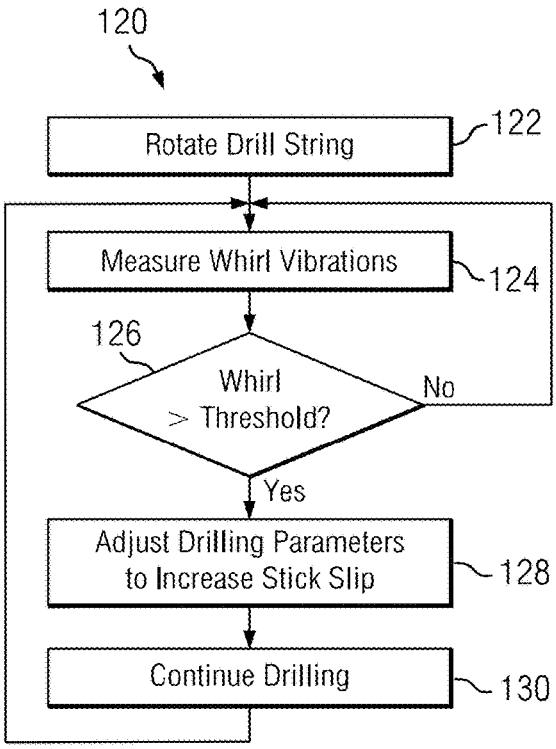
FIG. 6 depicts a flow chart of an example method for mitigating whirl while drilling a subterranean wellbore.

FIG. 6 depicts a flowchart of one such example method 120 for mitigating whirl while drilling. The method includes rotating the drill string in a wellbore at 122 (e.g., to drill). The initial drilling parameters may be selected, for example, with the intent of minimizing whirl. These parameters may be estimated, for example, via BHA modeling. Lateral vibrations (e.g., accelerations) indicative of whirl are measured at 124. The lateral (radial) vibrations or accelerations may be measured, for example, via downhole accelerometer deployments. Such accelerometers may be deployed substantially anywhere in the BHA, for example, in a rotary steerable tool, in an LWD tool, and/or in an MWD tool as described above (or even in the drill bit). A maximum lateral acceleration is then compared with a whirl threshold at 126. When the maximum lateral acceleration (i.e., the whirl) is greater than the threshold, the drilling parameters used to drill the well in 122 may be adjusted or perturbed at 128 so as to increase stick slip (and correspondingly decrease whirl). In one example embodiment, the threshold may be a lateral acceleration of greater than 5 g acceleration (e.g., greater than 10 g or greater than 20 g) at a frequency in a range from about 5 Hz to about 50 Hz. It will be appreciated that a suitable threshold may depend on the size and configuration of the drill string and BHA. Drilling continues at 130 as indicated.

Figure 7:
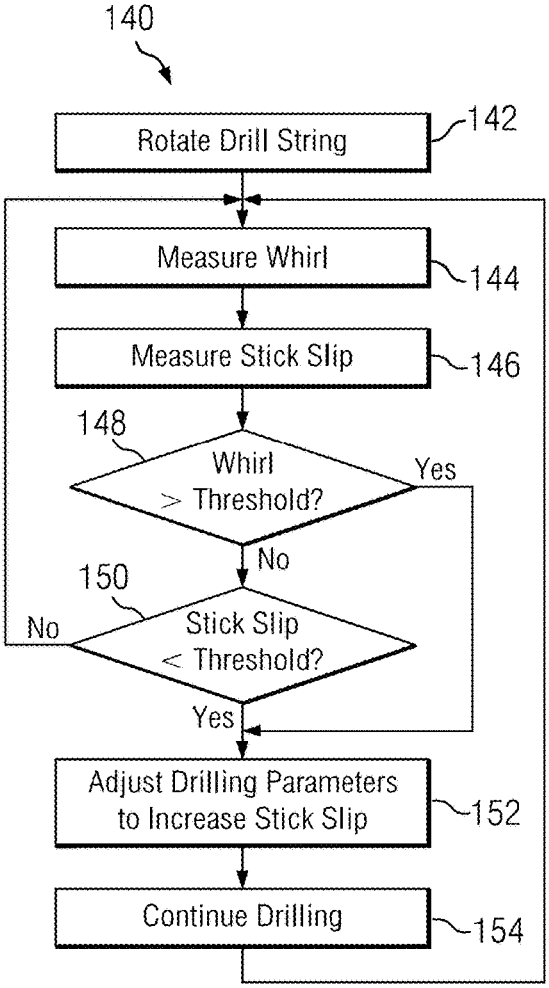
FIG. 7 depicts a flow chart of another example method for mitigating whirl while drilling a subterranean wellbore.

FIG. 7 depicts a flowchart of another example method 140 for mitigating whirl while drilling. The method includes rotating the drill string at 142 (e.g., to drill). Lateral accelerations indicative of whirl may be measured at 144. The stick slip amplitude is measured at 146 (e.g., via surface torque measurements). The measurements may be made, for example, as described above with respect to FIGS. 5 and 6. The maximum lateral acceleration is compared with a whirl threshold at 148 and the measured stick slip amplitude is compared with a stick slip threshold at 150. When the measured whirl exceeds the whirl threshold at 148 or the measured stick slip amplitude is less than the stick slip threshold at 150, the drilling parameters used to drill the well in 142 may be adjusted at 152 so as to increase stick slip (and correspondingly decrease whirl). Drilling continues at 154 as indicated.

With further reference to FIGS. 5-7, it will be appreciated that stick slip may be introduced, promoted, and/or increased, for example, via perturbing the rotation rate or torque of the drill string (e.g., at the top drive) and/or perturbing the weight on bit (or hook load). For example, the rotation rate of the drill string may be perturbed at a rate that is close to the stick slip frequency as shown in the sonogram in FIG. 4A. In such example embodiments, the rotation rate of the drill string may be increased or decreased (in the example shown on FIG. 4A the rotation rate of the drill string may be cycled through small increases or decreases from a current value at a frequency close to the resonant frequency of the drill string). In another example embodiment, the top-drive speed control loop output torque may be modified. This torque command may be modulated at the stick-slip frequency in order to promote/increase stick-slip. In another embodiment, the WOB setpoint may be perturbed or modulated at the stick-slip frequency.

With still further reference to FIGS. 5-7, it will be appreciated that methods 100, 120, and 140 may further evaluate the drill string or BHA dynamics for high-frequency torsional oscillation (HFTO) and harmonic stick slip oscillation. Those of ordinary skill will readily appreciate that these vibrational modes may be thought of as severe forms of stick slip that can cause excessive damage to the BHA, with HFTO being a higher frequency oscillation than harmonic stick slip oscillation.

Figure 8:
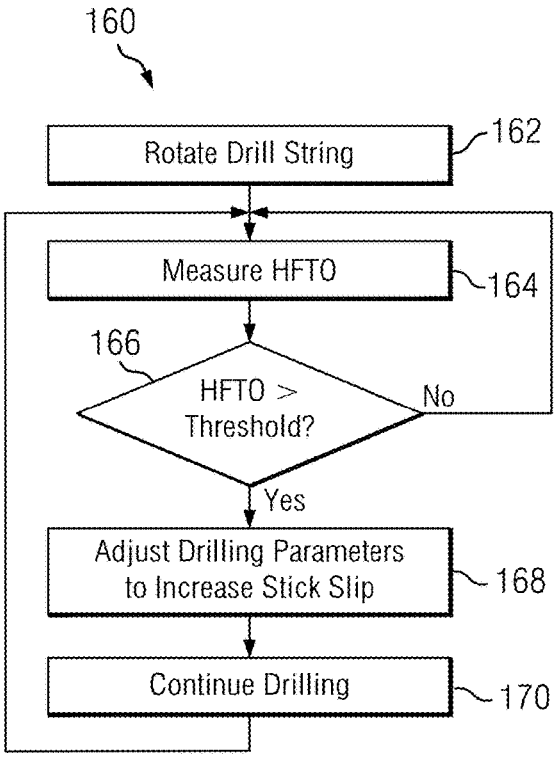
FIG. 8 depicts a flow chart of an example method for mitigating high frequency torsional oscillations during a wellbore operation.

FIG. 8 depicts a flow chart of an example method 160 for mitigating HFTO during a wellbore operation. The method 180 includes rotating the drill string in a wellbore at 162 (e.g., to drill). The initial drilling parameters may be selected, for example, with the intent of minimizing damaging vibrations such as HFTO. These parameters may be estimated, for example, via BHA modeling. Torsional vibrations (e.g., accelerations) indicative of HFTO are measured at 164. The torsional vibrations or accelerations may be measured, for example, via surface torque measurements made while rotating the drill string. A maximum torsional acceleration in a predetermined frequency window (e.g., in a frequency range from about 20 Hz to about 1000 Hz or from about 50 Hz to about 400 Hz) that is indicative of HFTO may then be compared with an HFTO threshold at 166. When the maximum torsional acceleration (i.e., the HFTO) is greater than the threshold, the drilling parameters used to drill the well in 162 may be adjusted or perturbed at 168 so as to increase stick slip (and correspondingly decrease HFTO). In one example embodiment, the threshold may be 20 rpm speed variation within the HFTO frequency range. HFTO may also be measured as a torsional acceleration. In such embodiments, an example threshold may be 5 g acceleration within the HFTO frequency window. It will be appreciated that a suitable threshold may depend on the size and configuration of the drill string and BHA. Drilling continues at 170 as indicated.

Figure 9:
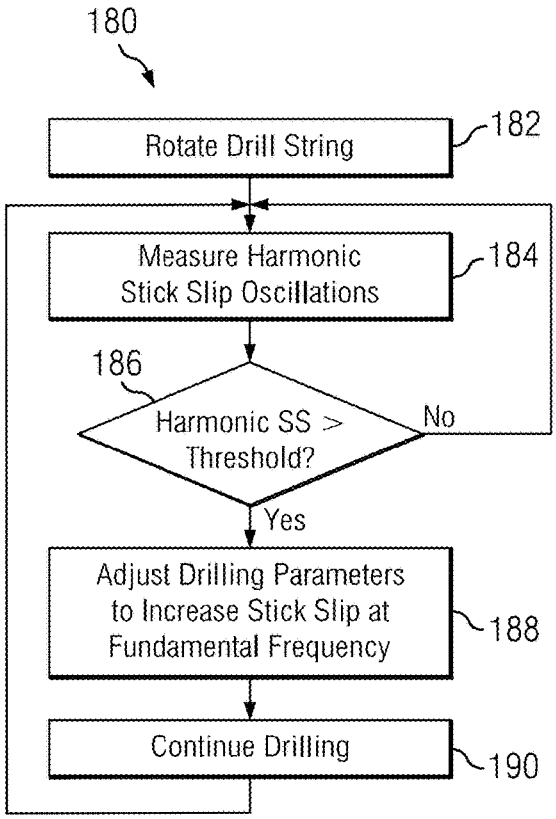
FIG. 9 depicts a flow chart of an example method for mitigating harmonic stick slip oscillations during a wellbore operation.

FIG. 9 depicts a flow chart of an example method 180 for mitigating harmonic stick slip oscillations during a wellbore operation. The method 180 includes rotating the drill string in a wellbore at 182 (e.g., to drill). The initial drilling parameters may be selected, for example, with the intent of minimizing damaging vibrations such as harmonic stick slip oscillations. These parameters may be estimated, for example, via BHA modeling. Torsional vibrations (e.g., accelerations) indicative of harmonic stick slip oscillations are measured at 184. The torsional vibrations or accelerations may be measured, for example, via surface torque measurements made while rotating the drill string. A maximum torsional acceleration in a predetermined frequency window that is indicative of harmonic stick slip oscillations may then be compared with a harmonic stick slip oscillation threshold at 186. When the maximum torsional acceleration (i.e., the harmonic stick slip oscillation) is greater than the threshold, the drilling parameters used to drill the well in 182 may be adjusted or perturbed at 188 so as to increase stick slip at the fundamental (non-harmonic) frequency (and correspondingly decrease the harmonic stick slip oscillations). Drilling continues at 190 as indicated.

The fundamental frequency is generally in a range from about 0.1 to about 0.5 Hz depending on the depth of the wellbore. Damaging harmonics tend to be odd integer multiples of the fundamental frequency, for example, third, fifth, seventh and so on, with fifth order harmonics and above generally being the most damaging. Therefore in example embodiments, a frequency window may be from about 0.5 Hz to about 5 Hz. In one example embodiment, the threshold may be a 10 rpm speed variation (e.g., 20 rpm or 30 rpm) at a frequency three times the fundamental frequency or greater. It will of course be appreciated that a suitable threshold may depend on the size and configuration of the drill string and BHA.

Figure 10:
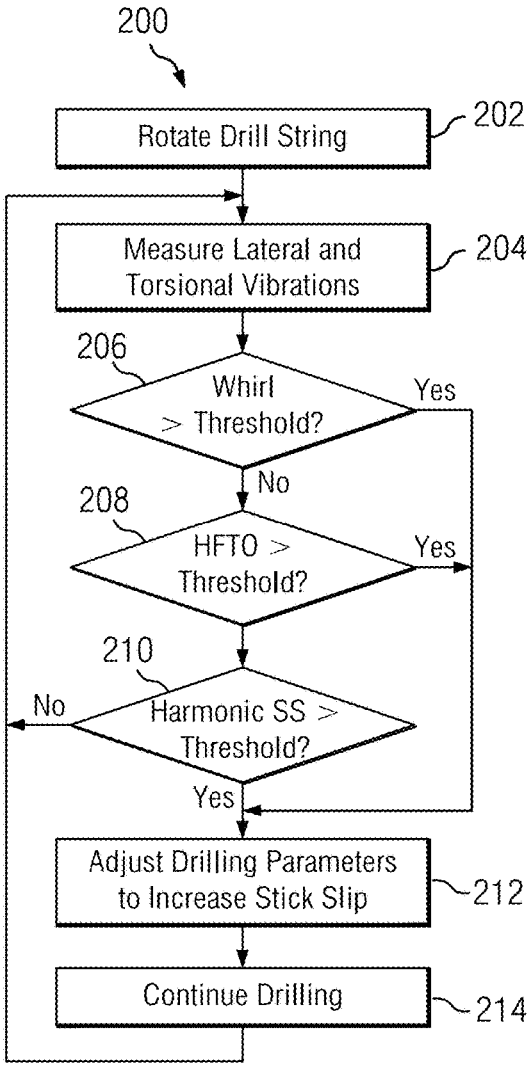
FIG. 10 depicts a flow chart of another example method for mitigating severe dynamic vibrations while drilling a subterranean wellbore.

FIG. 10 depicts a flow chart of another example method 200 for mitigating severe dynamic vibrations during a wellbore operation (e.g., while drilling). The method 200 includes rotating the drill string in a wellbore at 202 (e.g., to drill). The initial drilling parameters may be selected, for example, with the intent of minimizing the above noted damaging vibrations. Lateral vibrations (e.g., accelerations) indicative of whirl and torsional vibrations indicative of HFTO and harmonic stick slip oscillations are measured at 204. These vibrational modes may be measured, for example, as described above with respect to FIGS. 6-9, via downhole accelerometer deployments and surface torque measurements. A maximum lateral acceleration may be compared with a whirl threshold at 206, a maximum torsional acceleration in an HFTO frequency window may be compared with an HFTO threshold at 208, and a maximum torsional acceleration in a harmonic stick slip oscillation frequency window may be compared with a corresponding threshold at 210. If any one of the whirl, HFTO, or the harmonic stick slip oscillation exceeds the corresponding threshold, the drilling parameters used to drill the well in 202 may be adjusted or perturbed at 212 so as to increase stick slip at the fundamental (non-harmonic) frequency (and correspondingly decrease the severe dynamic vibrations). Otherwise drilling continues using the parameters established at 202. Drilling continues at 214 as indicated.

Figure 11:
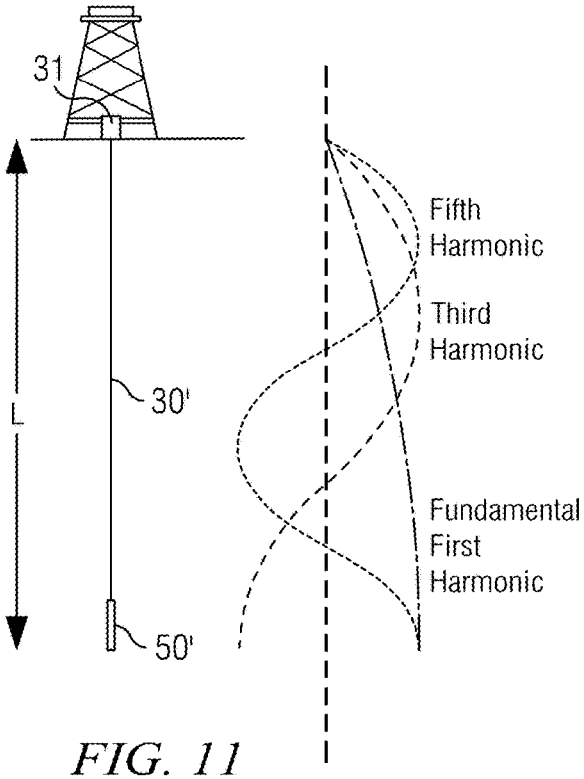
FIG. 11 depicts a schematic drill string comparing the stick slip amplitude of fundamental, third, and fifth harmonics.

FIG. 11 depicts example harmonic stick slip (torsional) oscillations in which the stick slip amplitude is depicted on the horizontal axis (the amplitude of the wave). Note that the oscillation occurs along the length of the drill string 30'. In the example depiction, the top drive 31 may be a node for the torsional oscillation and the BHA 50' may be an antinode. It will be appreciated that the actual coupling at the top drive 31 may not be a full node as the control system can provide some coupling which will vary with frequency. Moreover, the BHA 50' tends to be stiffer than the drill string and so tends not to be a perfect antinode. Notwithstanding, to a first approximation, the top drive may be taken to be a node and the BHA (or bit) may be taken to be an antinode.

With continued reference to FIG. 11, the fundamental frequency of the drill string length may be a quarter wavelength (e.g., $\lambda_F$=4L). The higher harmonics have shorter wavelengths (and corresponding higher frequencies). For example, the third harmonic may have a wavelength $\lambda_3$=4L/3 while the fifth harmonic may have a wavelength $\lambda_5$=4L/5. The frequency may be given as $f=v/\lambda$, where $v$ represents the wave speed in the drill string. The wave speed depends on the shear modulus and density of the drill string and is generally about $v\approx3{,}000$ m/s. At a well depth of about 3,000 m (about 10,000 ft), the fundamental frequency is about 0.25 Hz.

Figure 12A:
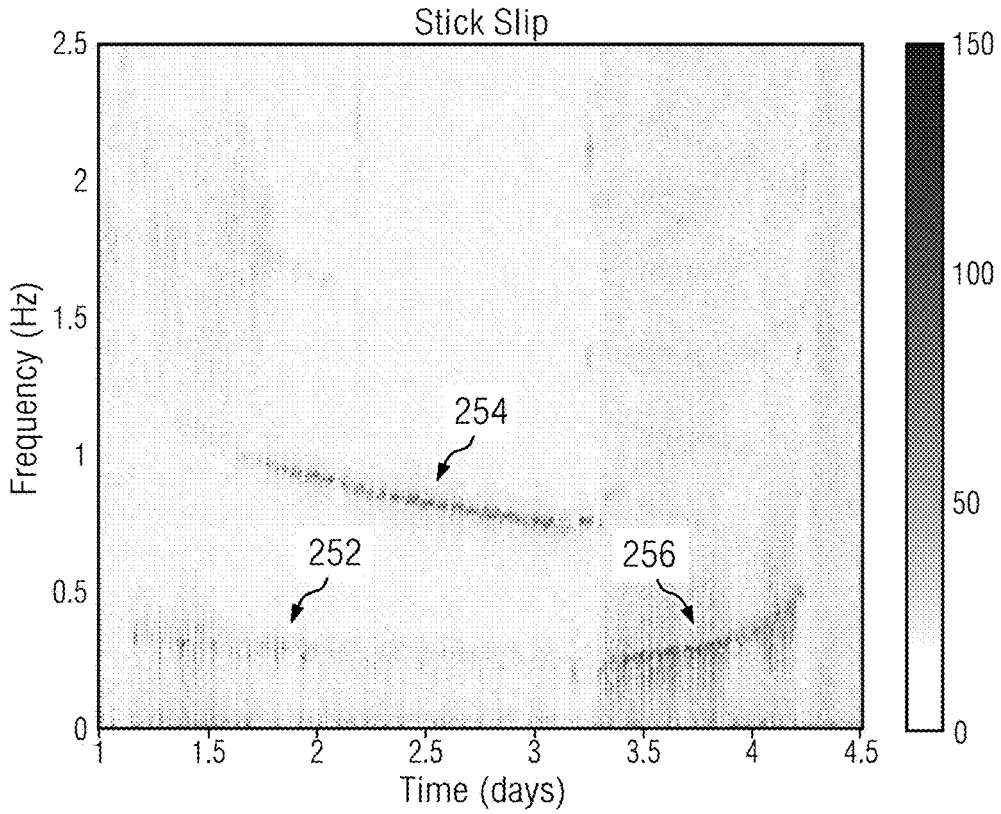
FIGS. 12A and 12B (collectively FIG. 12) depict example sonograms indicating stick slip and harmonic stick slip oscillations.
Figure 12B:
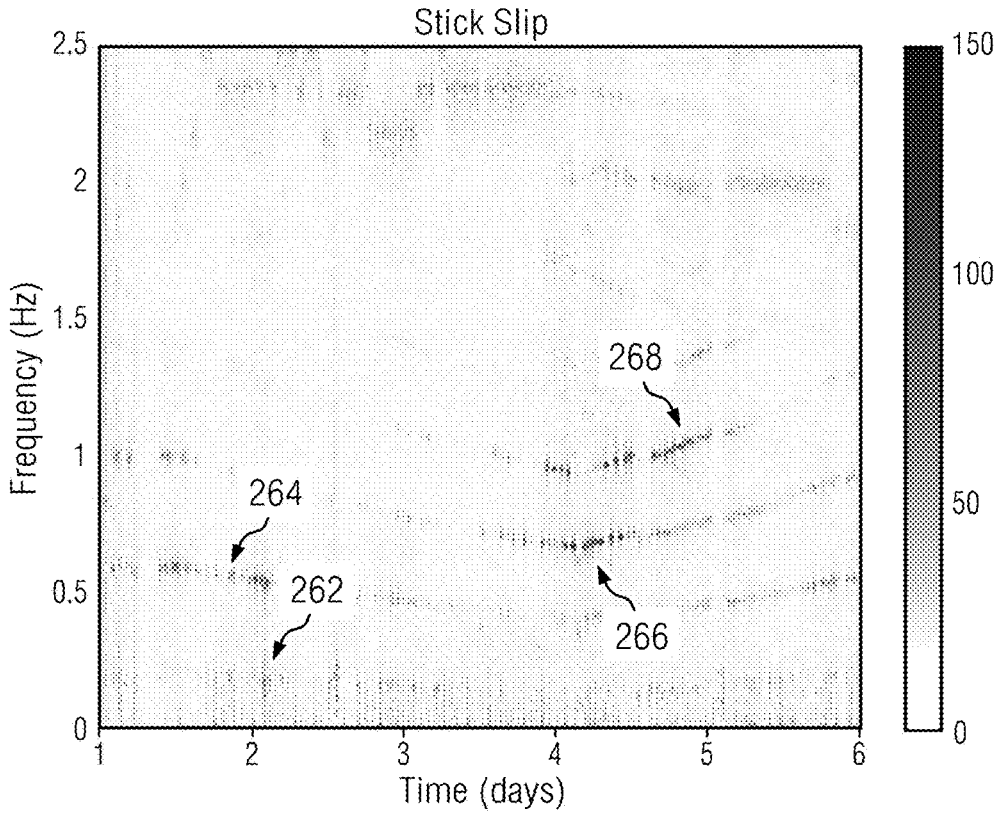

Turning now to FIGS. 12A and 12B example sonograms indicating stick slip and harmonic stick slip oscillations are depicted. FIG. 12A depicts a sonogram obtained while drilling a 17.5 inch (45 cm) section from a depth of about 2500 ft (750 m) to about 8000 ft (2450 m). In this sonogram, the fundamental frequency and third harmonic are observed while drilling at 252 and 254. However, when tripping out of the hole only the fundamental frequency is observed at 256. At full depth the fundamental frequency is about 0.3 Hz.

FIG. 12B depicts a sonogram obtained while drilling an 8.5 inch (22 cm) section from a depth of about 11,000 ft (3,300 m) to about 17,000 ft (5,100 m). In this sonogram, bursts of the fundamental frequency are observed through the run at 262, but they not sustained. During drilling the primary frequency is the third harmonic at 264. The fundamental frequency at full depth is about 0.15 Hz. However, when tripping out of the hole, the fifth and seventh harmonics are sustained at a significant amplitude at 266 and 268. Such dynamic conditions are believed to damage pipe threads, particularly at the node locations.

It will be appreciated that the damaging vibrations can be particularly problematic when tripping out of the hole. During such tripping operations, it may be advantageous to mitigate against backwards whirl and harmonic stick slip oscillations. One practical way to perform such mitigation is to disable stick slip mitigation in the top drive. As described above, mitigation of backwards whirl and harmonic stick slip oscillations may further include monitoring lateral and torsional vibrations. When damaging oscillations are observed they may be inhibited via changing the top drive control algorithm or by injecting a low amplitude fundamental frequency of torque or speed to trigger the lower frequency resonance (i.e., to promote stick slip at the fundamental frequency).

As described above, the disclosed embodiments may further include a system for drilling a wellbore that mitigates whirl, HFTO, and/or harmonic stick slip oscillations. The system may include computer hardware and software configured to receive HFTO, harmonic stick slip amplitude, and or whirl measurements and to recommend changes to the drilling parameters when required to mitigate the damaging vibrations. The whirl measurements may be made downhole, for example, as described above and may be transmitted to the surface via conventional telemetry techniques, such as mud pulse and mud siren telemetry. In example embodiments, the whirl measurements may be encoded as two-bit quantities indicating low, medium, high, and severe whirl, however the disclosed embodiments are not limited in this regard.

The disclosed embodiments may further include an automated system for drilling a wellbore that mitigates damaging vibrations. The system may include computer hardware and software configured to receive harmonic stick slip oscillations, HFTO, and/or whirl measurements and to automatically control parameters (such as a top drive rotation rate) in response to the measurements. The hardware may include one or more processors (e.g., microprocessors) which may be connected to data storage devices (e.g., hard drives or solid state memory) and user interfaces. It will be further understood that the disclosed embodiments may include processor executable instructions stored in the data storage device. The disclosed embodiments are, of course, not limited to the use of or the configuration of any particular computer hardware and/or software.

Although mitigation of severe dynamic vibrations via stick slip promotion has been described in detail, it should be understood that various changes, substitutions and alternations can be made herein without departing from the spirit and scope of the disclosure as defined by the appended claims.

We claim:

1. A method for drilling a subterranean wellbore, the method comprising:

rotating a drill string in the wellbore;

measuring each one of a whirl, a high frequency torsional oscillation, and a harmonic stick slip oscillation while rotating;

comparing the measured whirl with a corresponding whirl threshold, comparing the measured high frequency torsional oscillation with a corresponding high frequency torsional oscillation threshold, and comparing the measured harmonic stick slip oscillation with a corresponding harmonic stick slip oscillation threshold; and changing at least one operational parameter that controls the rotating to increase stick slip when the at least one of the whirl, the high frequency torsional oscillation, and the harmonic stick slip oscillation exceeds the corresponding threshold.

2. The method of claim 1, wherein the at least one operational parameter comprises a rotation rate of the drill string or a torque applied to the drill string.

3. The method of claim 1, wherein the changing is configured to inject a low amplitude torque or a rotation speed at a fundamental frequency to trigger stick slip at the fundamental frequency.

4. The method of claim 1, wherein the changing is configured to set the rotation rate of the drill string equal to a fundamental stick slip frequency.

5. The method of claim 1, wherein:

the whirl is estimated from measurements of lateral vibrations in a bottom hole assembly; and the high frequency torsional oscillation and the harmonic stick slip oscillation are estimated from torsional oscillations measured at a top drive.

6. The method of claim 1, wherein:

the whirl is estimated from measurements of lateral vibrations in a bottom hole assembly.

7. The method of claim 6, wherein the whirl is estimated from a maximum radial acceleration in the bottom hole assembly.

8. The method of claim 1, wherein:

at least one of the high frequency torsional oscillation and the harmonic stick slip oscillation is estimated from torsional oscillations measured at a top drive.

9. The method of claim 8, wherein:

the harmonic stick slip oscillation is estimated by transforming the measured torsional oscillations to a frequency domain; and the estimated harmonic stick slip oscillation comprises a fifth order or higher harmonic oscillation.

10. The method of claim 1, wherein:

the whirl is represented by a maximum lateral acceleration;

the high frequency torsional oscillation is represented by a maximum torsional acceleration in a high frequency torsional oscillation window; and the harmonic stick slip oscillation is represented by a maximum torsional acceleration in a harmonic stick slip oscillation window.

11. A system for drilling a subterranean wellbore, the system comprising:

a drill string configured to rotate in the wellbore; and a processor configured to:

receive each one of a measured whirl, a measured high frequency torsional oscillation, and a measured harmonic stick slip oscillation while the drill string rotates in the wellbore;

compare the measured whirl with a corresponding whirl threshold;

compare the measured high frequency torsional oscillation with a corresponding high frequency torsional oscillation threshold; and compare the measured harmonic stick slip oscillation with a corresponding harmonic stick slip oscillation threshold; and determine change to at least one operational parameter that controls rotation of the drill string to promote stick slip when the at least one of the measured whirl, the measured high frequency torsional oscillation, and the measured harmonic stick slip oscillation exceeds the corresponding threshold.

12. The system of claim 11, wherein the processor is further configured to:

receive a measured stick slip amplitude while the drill string rotates in the wellbore;

compare the measured stick slip amplitude with a stick slip threshold; and determine change to the at least one operational parameter that controls rotation of the drill string to promote stick slip when the measured stick slip amplitude is less than the stick slip threshold.

13. The system of claim 11, wherein the at least one operational parameter comprises a rotation rate of the drill string or a torque applied to the drill string.

14. The system of claim 11, wherein the processor is further configured to automatically implement the determined change to the at least one operational parameter.

15. The system of claim 11, wherein:

the change to the at least one operational parameter is configured to inject a low amplitude torque or a rotation speed at a fundamental frequency to trigger stick slip at the fundamental frequency.

16. The system of claim 11, wherein:

the change to the at least one operational parameter is configured to set the rotation rate of the drill string equal to a fundamental stick slip frequency.

17. The system of claim 11, wherein:

the measured whirl is estimated from measurements of lateral vibrations in a bottom hole assembly; and the measured high frequency torsional oscillation and the measured harmonic stick slip oscillation are estimated from torsional oscillations measured at a top drive.

18. The system of claim 11, wherein:

the whirl is estimated from measurements of lateral vibrations in a bottom hole assembly.

19. The system of claim 11, wherein:

at least one of the high frequency torsional oscillation and the harmonic stick slip oscillation is estimated from torsional oscillations measured at a top drive.

20. The system of claim 11, wherein:

the whirl is represented by a maximum lateral acceleration;

the high frequency torsional oscillation is represented by a maximum torsional acceleration in a high frequency torsional oscillation window; and the harmonic stick slip oscillation is represented by a maximum torsional acceleration in a harmonic stick slip oscillation window.

* * * * *